US007185628B1

(12) United States Patent
Holm et al.

(10) Patent No.: US 7,185,628 B1
(45) Date of Patent: Mar. 6, 2007

(54) CONTINUOUS ENGINE REVERSE ROTATION DETECTION SYSTEM

(75) Inventors: Eric Ralph Holm, Brighton, MI (US); Jason Thomas Davis, Williamston, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 11/263,176

(22) Filed: Oct. 31, 2005

(51) Int. Cl.
*F02B 75/02* (2006.01)

(52) U.S. Cl. ..... 123/319; 123/491

(58) Field of Classification Search ..... 123/319, 123/491, 631; 73/116, 117.3; 701/110
See application file for complete search history.

(56) References Cited

U.S. PATENT DOCUMENTS 4,491,122 A * 1/1985 Piteo ..... 123/631
4,909,229 A * 3/1990 Hashizume ..... 123/631
5,604,304 A * 2/1997 Kokubo et al. ..... 73/117.3
6,732,713 B1 * 5/2004 Kanazawa et al. ..... 123/476
7,017,556 B2 * 3/2006 Borg et al. ..... 123/491
7,047,956 B2 * 5/2006 Masaoka et al. ..... 123/631

* cited by examiner

*Primary Examiner*—Willis R. Wolfe, Jr.
*Assistant Examiner*—Johnny H. Hoang
(74) *Attorney, Agent, or Firm*—Christopher DeVries

(57) ABSTRACT

A reverse rotation detection system for an engine with at least one camshaft and a crankshaft includes a camshaft position sensor that generates a camshaft position signal based on a rotation of the camshaft. A second sensor input device generates a crankshaft position signal based on a rotation of the crankshaft. A control module detects a reverse rotation condition of the engine from the camshaft position signal and the crankshaft position signal, wherein the control module compares the camshaft position signal to the crankshaft position signal to determine an engine position. Based on the engine position the control module compares the camshaft position signal to an expected signal to determine a reverse rotation condition.

25 Claims, 4 Drawing Sheets

CONTINUOUS ENGINE REVERSE ROTATION DETECTION SYSTEM

FIELD OF THE INVENTION

The present invention relates to internal combustion engines, and more particularly to systems and methods for detecting continuous reverse rotation of an internal combustion engine.

BACKGROUND OF THE INVENTION

An internal combustion engine generally operates in four modes; an intake mode, a compression mode, a combustion mode and an exhaust mode. During reverse rotation of an engine, the engine cycle executes in a reverse order whereby the compression mode is followed by the intake mode. For example, when an engine that is stopped begins to start again, the engine may have a cylinder that was in a compression mode at the moment of stopping. Compression pressure in the cylinder may push a piston in reverse toward bottom dead center (BDC). When engine speed increases, a cylinder with injected fuel may experience ignition and the reverse rotation may be accelerated.

It is unlikely that a conventional engine will rotate in reverse for a long period of time. Torque control systems are capable of limiting the duration of the reverse rotation. However, the problem arises more frequently in hybrid electric propulsion systems. An external force (such as an electric motor) can rotate the internal combustion engine in reverse for longer durations at higher speeds. Conventional torque control systems are not able to control torque under these conditions.

If reverse rotation occurs, engine components such as the intake manifold can be damaged. Reverse rotation may cause a compressed air/fuel mixture to flow back into the intake manifold during the intake stroke through an open intake valve. Pressure in the intake manifold increases. If further reverse rotation occurs, pressure may increase further and cause damage to the intake manifold.

SUMMARY OF THE INVENTION

Accordingly, a reverse rotation detection system for an engine with at least one camshaft and a crankshaft includes a camshaft position sensor that generates a camshaft position signal based on a rotation of the camshaft. A second sensor input device generates a crankshaft position signal based on a rotation of the crankshaft. A control module detects a reverse rotation condition of the engine from the camshaft position signal and the crankshaft position signal, wherein the control module compares the camshaft position signal to the crankshaft position signal to determine an engine position. Based on the engine position the control module compares the camshaft position signal to an expected signal to determine a reverse rotation condition.

In one other feature, if the engine position indicates that the camshaft is retarded relative to the crankshaft, the expected signal is selectable for a crankshaft region. The region is defined by a first crankshaft angle and a second crankshaft angle referenced relative to top dead center of a cylinder of the engine. The control module compares an edge of the camshaft position signal to an edge of the expected signal.

In other features, if the engine position indicates that the camshaft and the crankshaft are synchronized, the expected signal is the camshaft position signal at a region of the camshaft stored during a previous rotation of the crankshaft. The region is defined by a first camshaft angle and a second camshaft angle. The control module compares a state of the camshaft position signal to a state of the expected signal.

In still other features, the system includes a wheel coupled to the camshaft having a plurality of teeth, wherein the camshaft position sensor generates the camshaft sensor signal based on the plurality of teeth of the wheel. The system can also include a wheel coupled to the crankshaft having a plurality of teeth, wherein the crankshaft position sensor generates the crankshaft position signal based on the plurality of teeth of the wheel.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
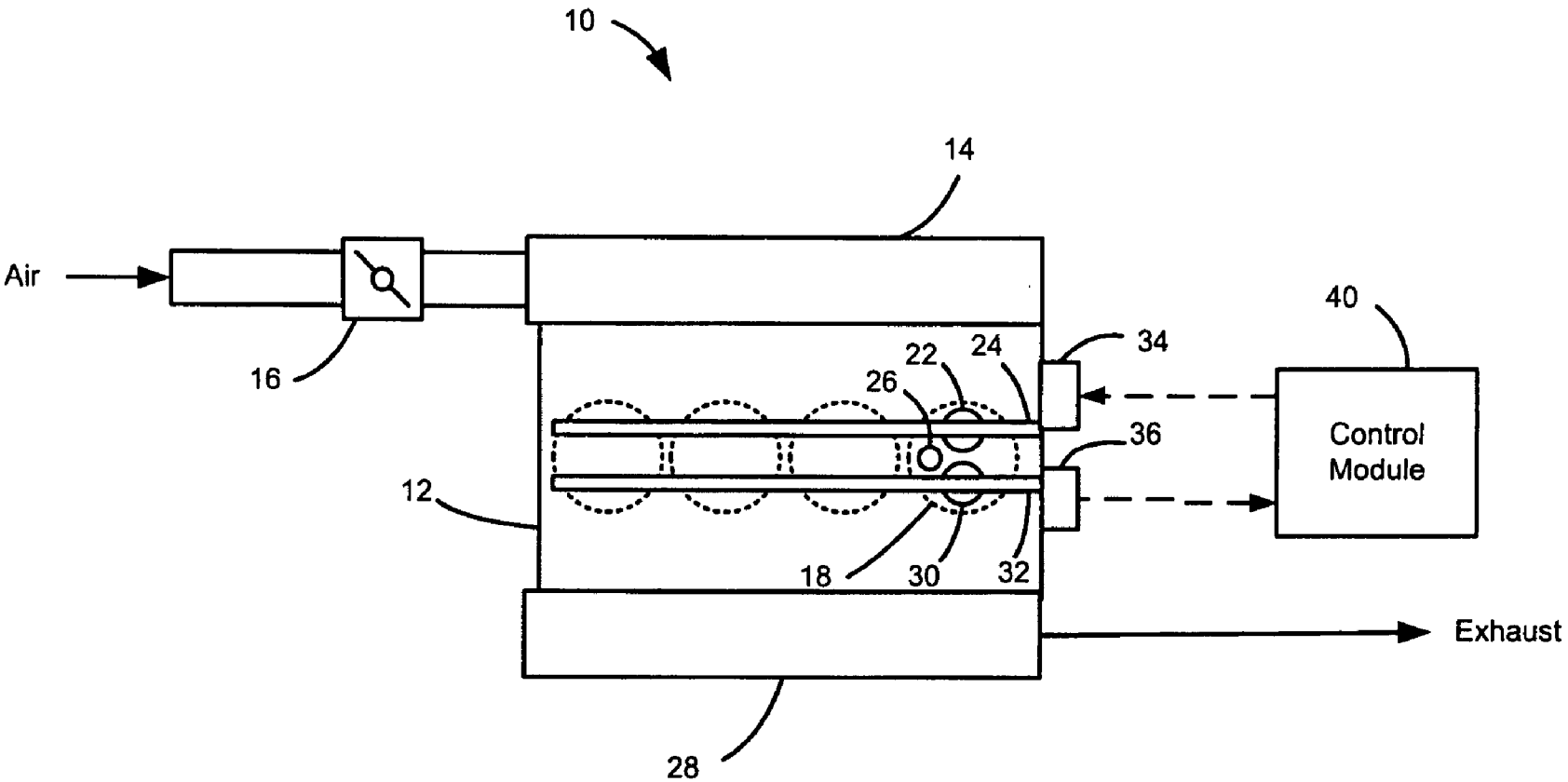
FIG. 1 is a schematic illustration of the top view of an engine system.

The following description of the preferred embodiment is merely exemplary in nature and is in no way intended to limit the invention, its application, or uses. For purposes of clarity, the same reference numbers will be used in the drawings to identify similar elements. As used herein, the term module refers to an application specific integrated circuit (ASIC), an electronic circuit, a processor (shared, dedicated, or group) and memory that execute one or more software or firmware programs, a combinational logic circuit, and/or other suitable components that provide the described functionality.

Referring now to FIG. 1, an engine system 10 includes an engine 12 that combusts an air and fuel mixture to produce drive torque. Air is drawn into an intake manifold 14 through a throttle 16. The throttle 16 regulates mass air flow into the intake manifold 14. Air within the intake manifold 14 is distributed into cylinders 18. Although four cylinders 18 are illustrated, it can be appreciated that the engine can have a plurality of cylinders including, but not limited to, 2, 3, 5, 6, 8, 10, 12 and 16 cylinders.

A fuel injector (not shown) injects fuel that is combined with the air as it is drawn into the cylinder 18 through an intake port. An intake valve 22 selectively opens and closes to enable the air/fuel mixture to enter the cylinder 18. The intake valve position is regulated by an intake camshaft 24. A piston (not shown) compresses the air/fuel mixture within the cylinder 18. A spark plug 26 initiates combustion of the air/fuel mixture, driving the piston in the cylinder 18. The piston drives a crankshaft (not shown) to produce drive torque. Combustion exhaust within the cylinder 18 is forced out through an exhaust manifold 28 when an exhaust valve 30 is in an open position. The exhaust valve position is regulated by an exhaust camshaft 32. The exhaust is treated in an exhaust system. Although single intake and exhaust valves 22,30 are illustrated, it can be appreciated that the engine 12 can include multiple intake and exhaust valves 22,30 per cylinder 18.

The engine system 10 can include an intake cam phaser 34 and/or an exhaust cam phaser 36 that respectively regulate the rotational timing of the intake and exhaust camshafts 24,32. More specifically, the timing or phase angle of the respective intake and exhaust camshafts 24,32 can be retarded or advanced with respect to each other or with respect to a location of the piston within the cylinder 18 or crankshaft position. In this manner, the position of the intake and exhaust valves 22,30 can be regulated with respect to each other or with respect to a location of the piston within the cylinder 18. By regulating the position of the intake valve 22 and the exhaust valve 30, the quantity of air/fuel mixture ingested into the cylinder 18 and therefore the engine torque is regulated. A control module 40 controls the phase angle of the intake cam phaser 34 and exhaust cam phaser 36 based on a desired torque.

Figure 2:
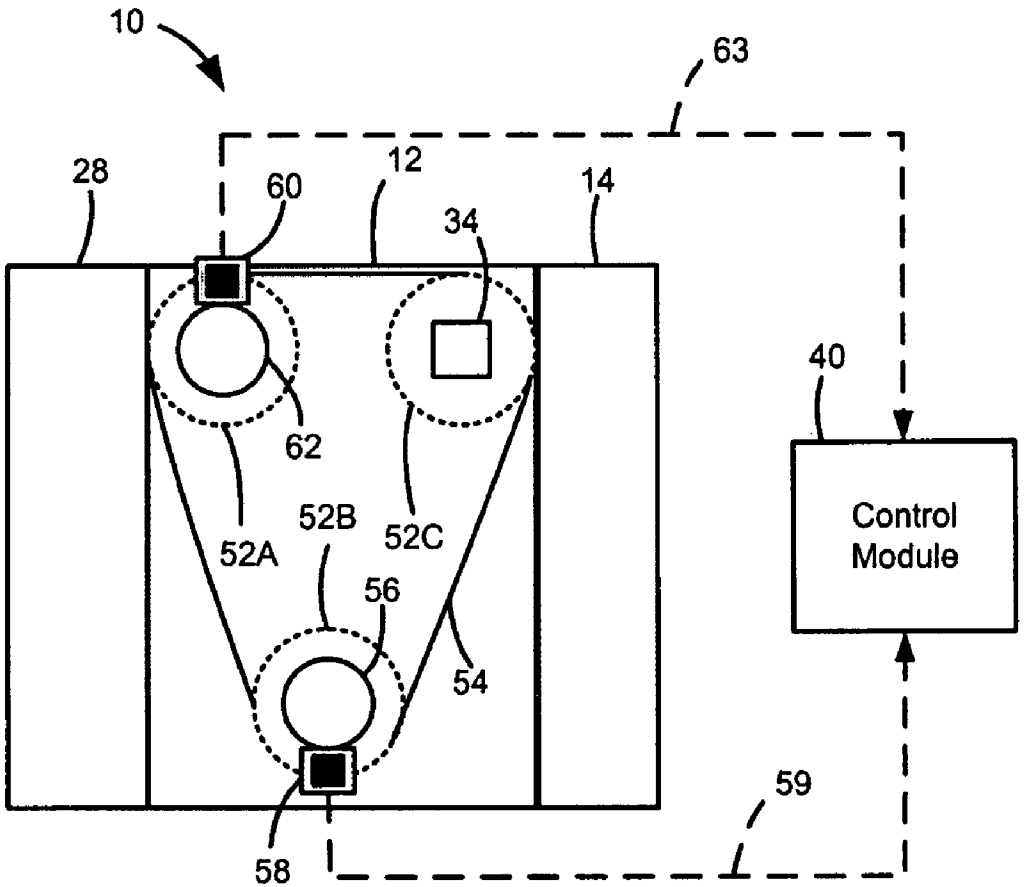
FIG. 2 is a schematic illustration of the side view of an engine system.

Referring now to FIG. 2, a side view of the engine system 10 is shown. The exhaust camshaft 32 (FIG. 1) and the intake camshaft 24 (FIG. 1) are coupled to the crankshaft (not shown) via sprockets 52A, 52B, and 52C and a timing chain 54. The engine system 10 outputs a crankshaft signal 59 to the control module 40 indicating the position of the crankshaft. The crankshaft signal 59 is generated by the rotation of a wheel 56 coupled to the crankshaft. The wheel 56 can have a plurality of teeth. A wheel sensor 58 senses the teeth of the wheel and generates the crankshaft signal 59 in a periodic form. The control module 40 decodes the crankshaft signal 59 to a specific tooth number of the wheel 56. Crankshaft position is determined from the decoded tooth number of the wheel 56.

Similarly, a wheel sensor 60 senses the teeth of a wheel 62 coupled to the exhaust camshaft 32 (FIG. 1) and generates a camshaft signal 63. Camshaft position is determined from the camshaft signal 63. As can be appreciated, a wheel (not shown) and wheel sensor (not shown) can be coupled to the intake camshaft 24 (FIG. 1) either additionally or alternatively. From the camshaft position and the crankshaft position, the control module 40 can determine an overall engine position. In addition, the control module 40 can detect reverse rotation of the engine by evaluating the crankshaft signal 59 and the camshaft signal 63.

Figure 3:
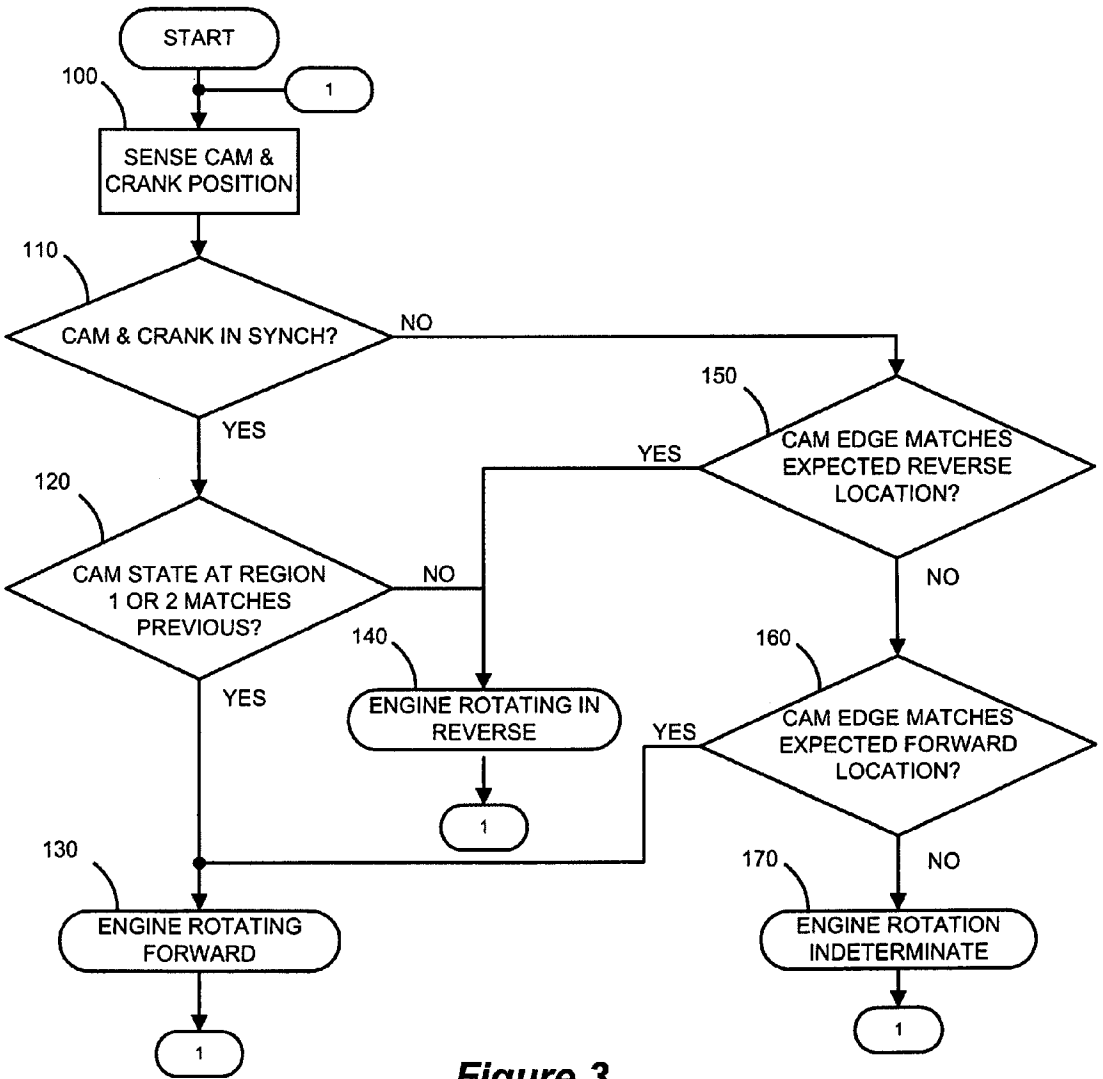
FIG. 3 is a flowchart illustrating steps taken by the engine system to detect a reverse rotation of the engine according to the present invention.

Referring now to FIG. 3, the flow of control executed by the control module 40 according to the present invention will be described in more detail. In order to detect reverse rotation of an engine, control first determines an engine position that indicates whether the camshaft and crankshaft are synchronized. For purposes of clarity, the following discussion relates to the exhaust camshaft. As can be appreciated, a similar approach can also be applied to the intake camshaft.

In step 100, the wheel sensors sense the position of the camshaft and the crankshaft. The position of the camshaft is determined relative to the position of the crankshaft. The camshaft and the crankshaft are synchronized if their states match a pre-selected pattern, and the engine has sustained it's own forward rotation as measured by crankshaft speed. If the camshaft and crankshaft are synchronized in step 110, a state of the camshaft signal is evaluated in step 120 for a selectable region defined by a first and a second angle of the camshaft. The state of the signal can be either high or low. In step 120, if an actual cam signal state matches a cam signal state previously sensed at the selectable region, the engine is rotating in a forward direction at step 130. Otherwise if an actual cam signal state does not match a cam signal state previously sensed at the selectable region, the engine is rotating in a reverse direction at step 140.

Referring back to step 110, otherwise, if the camshaft and crankshaft are not synchronized, in steps 150 and 160 an edge of the camshaft sensor signal is evaluated at a region defined by a first and a second angle of the crankshaft referenced relative to top dead center of a cylinder. The reference cylinder can be selectable. The signal edge can be either low to high or high to low. In step 150, if an actual camshaft signal edge matches an expected reverse camshaft signal edge for that region, the engine is rotating in a reverse direction at step 140. Otherwise, in step 160, if an actual camshaft signal edge matches an expected forward camshaft signal edge for that region, the engine is rotating in a forward direction at step 130. Otherwise, the rotation of the engine is indeterminate at step 170. The expected forward camshaft signal edge and the expected reversed camshaft signal edge can be selectable according to an angle of the camshaft.

Figure 4:
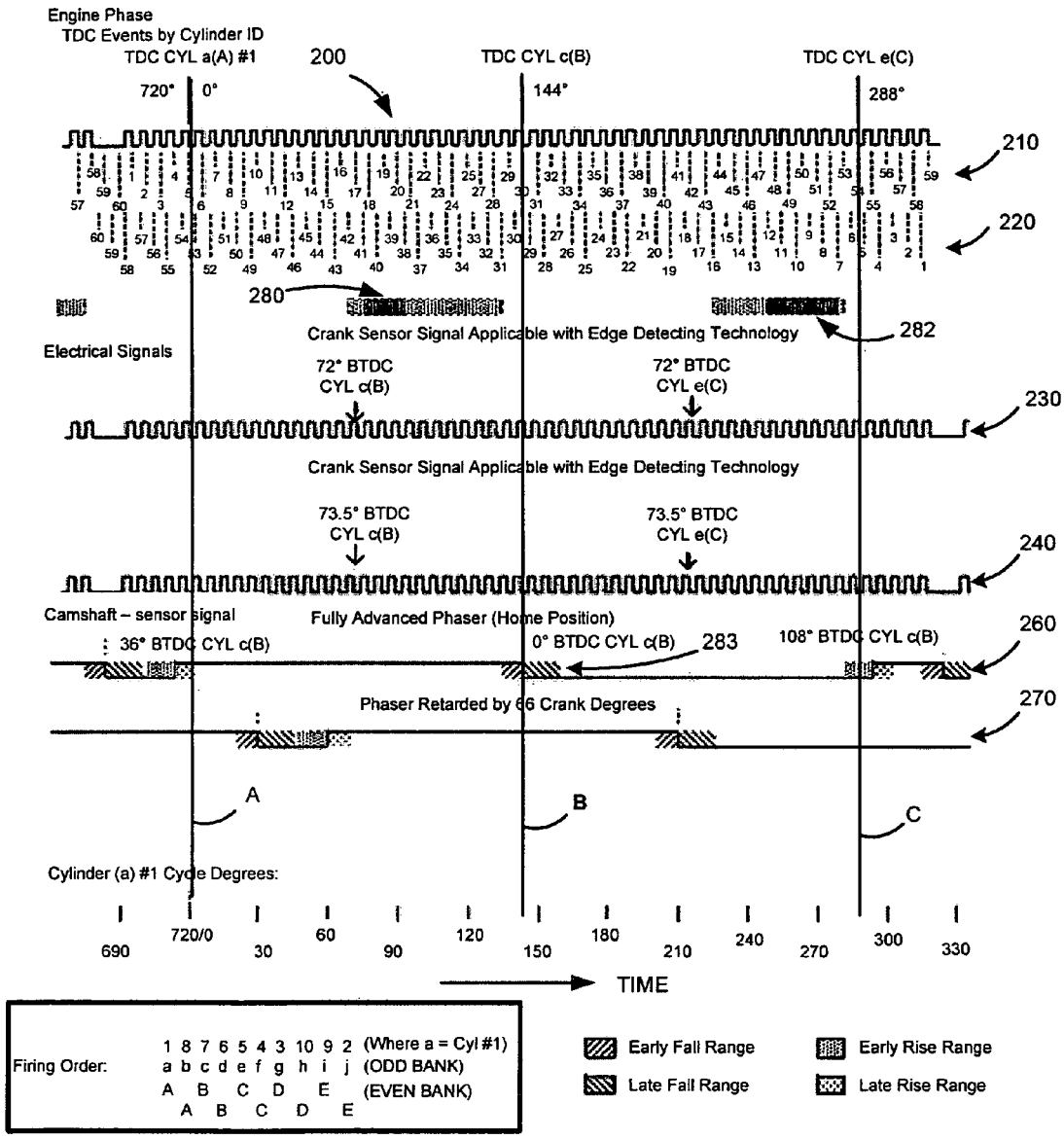
FIG. 4 is a timing diagram illustrating exemplary signals used to detect a reverse rotation of the engine.

Referring now to FIG. 4, an example of the reverse rotation detection method is shown for a 58× crankshaft sensor signal and a 4× camshaft sensor signal. A pulse train generated by the wheel sensor for a wheel having fifty-eight teeth that is coupled to the crankshaft is shown at 200. Decoded teeth numbers for an engine rotating in forward direction are shown at 210. Decoded teeth numbers for an engine rotating in reverse direction are shown at 220. The pulse train for the crankshaft may either be generated using an edge detecting technology as shown in 230 or with a center of tooth sensing technology as shown in 240. A pulse train generated by the wheel sensor for a wheel having four teeth that is coupled to camshaft when the cam phaser is fully advanced is shown at 260. A pulse train generated by the wheel sensor for a wheel having four teeth that is coupled to the camshaft when the cam phaser is retarded by sixty-six crank degrees is shown at 270. Lines A–C represent crank angles in degrees for when the piston of cylinders A–C are located at top dead center (TDC).

According to the present invention, an engine position is determined from a crankshaft signal and a camshaft signal. When the crankshaft and camshaft are synchronized, the cam sensor signal can be evaluated twice per one revolution of the crankshaft to determine the rotation of the engine. For example, regions shown at 280 and 282 define when the cam sensor signal can be evaluated for a 58× crank 4× cam sensing strategy. Regions 280 and 282 correspond to cam angle regions where the decoded forward teeth numbers of the crankshaft wheel are 18–20 and 46–51 respectively. The same regions are also defined by decoded reverse teeth numbers 39–41 and 8–12 respectively. The camshaft sensor signal state is compared to the previous camshaft sensor signal state for these regions 280 and 282 to determine if the engine is rotating in reverse. If the cam sensor signal state does not match the previous cam sensor signal state, the engine is rotating in reverse.

If the crankshaft and camshaft are not synchronized, the edges of the cam sensor signal can be evaluated at a selectable region defined by a crank angle in degrees relative to TDC for a cylinder. In the current example, the selectable region can be between 138 degrees and 150 degrees shown at 283. Within this region, the edges of the cam sensor signal are compared against an edge of an expected cam sensor signal. The expected edge can be selectable based on an angle of the crankshaft relative to top dead center of a cylinder. If the edge matches an expected edge for reverse rotation, the engine is rotating in reverse.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A method of detecting reverse rotation of an engine, comprising:

generating a camshaft position signal;

generating a crankshaft position signal;

determining an engine position based on said camshaft position signal and said crankshaft position signal;

generating an expected signal based on said engine position;

comparing said camshaft position signal to said expected signal; and generating a reverse rotation signal if said camshaft position signal equals said expected signal.

2. The method of claim 1 further comprising storing said camshaft position signal and wherein said step of generating said expected signal includes generating said expected signal from said previously stored camshaft position signal when said position of said engine indicates that said engine is synchronized.

3. The method of claim 2 wherein said step of comparing includes comparing a state of said camshaft position signal to a state of said expected signal when said position of said engine indicates that said engine is synchronized.

4. The method of claim 3 wherein said step of storing and said step of comparing are performed twice per crankshaft revolution at a region defined by a first camshaft angle and a second camshaft angle.

5. The method of claim 1 wherein said step of generating said expected signal includes generating said expected signal from a selectable signal for a specified region when said position of said engine indicates that said engine is not synchronized.

6. The method of claim 5 wherein said step of comparing includes comparing an edge of said camshaft position signal to an edge of said expected signal when said position of said engine indicates that said engine is not synchronized.

7. The method of claim 6 wherein said specified region is defined by a first crankshaft angle and a second crankshaft angle referenced relative to top dead center of a cylinder of said engine.

8. The method of claim 1 wherein said step of generating said camshaft position signal includes generating said camshaft position signal from a wheel sensor sensing a plurality of teeth of a wheel coupled to a camshaft of the engine.

9. The method of claim 1 wherein said step of generating said crankshaft position signal includes generating said crankshaft position signal from a wheel sensor sensing a plurality of teeth of a wheel coupled to a crankshaft of the engine.

10. The method of claim 1 wherein said step of determining includes determining a position of said engine based on whether a cam phaser of said camshaft is actively retarding said camshaft.

11. A reverse rotation detection system for an engine with at least one camshaft and a crankshaft, comprising:

a camshaft position sensor that generates a camshaft position signal based on a rotation of a camshaft;

a second sensor input device that generates a crankshaft position signal based on a rotation of a crankshaft; and a control module that detects a reverse rotation condition of an engine from said camshaft position signal and said crankshaft position signal, wherein said control module compares said camshaft position signal to said crankshaft position signal to determine an engine position, and wherein based on said engine position said control module compares said camshaft position signal to an expected signal to determine a reverse rotation condition.

12. The system of claim 11 wherein if said engine position indicates that said camshaft is retarded relative to said crankshaft, said expected signal is selectable for a crankshaft region, and wherein said region is defined by a first crankshaft angle and a second crankshaft angle referenced relative to top dead center of a cylinder of said engine.

13. The system of claim 11 wherein if said engine position indicates that said camshaft and said crankshaft are synchronized, said expected signal is said camshaft position signal at a region of said camshaft stored during a previous rotation of said crankshaft, and wherein said region is defined by a first camshaft angle and a second camshaft angle.

14. The system of claim 12 wherein said control module compares an edge of said camshaft position signal to an edge of said expected signal.

15. The system of claim 13 wherein said control module compares a state of said camshaft position signal to a state of said expected signal.

16. The system of claim 11 further comprising a wheel coupled to said camshaft having a plurality of teeth, wherein said camshaft position sensor generates said camshaft sensor signal based on said plurality of teeth of said wheel.

17. The system of claim 11 further comprising a wheel coupled to said crankshaft having a plurality of teeth, wherein said crankshaft position sensor generates said crankshaft position signal based on said plurality of teeth of said wheel.

18. The system of claim 11 further comprising a cam phaser coupled to said camshaft, wherein said control module commands said cam phaser to retard said camshaft relative to said crankshaft.

19. A method of detecting reverse rotation of an engine from a camshaft position signal and a crankshaft position signal, comprising:

receiving a camshaft position signal from said engine;

receiving a crankshaft position signal from said engine;

generating an expected signal based on whether said camshaft position signal and said crankshaft position signal indicate that said engine is synchronized;

comparing said camshaft position signal to said expected signal; and generating a reverse rotation signal if said camshaft position signal equals said expected signal.

20. The method of claim 19 further comprising storing said camshaft position signal and wherein said step of generating said expected signal includes generating said expected signal from said previously stored camshaft position signal when said position of said engine indicates that said engine is synchronized.

21. The method of claim 20 wherein said step of comparing includes comparing a state of said camshaft position signal to a state of said expected signal when said camshaft position signal and said crankshaft position signal indicate that said engine is synchronized.

22. The method of claim 21 wherein said step of storing and said step of comparing are performed twice per one revolution of a crankshaft at a region defined by a first camshaft angle and a second camshaft angle.

23. The method of claim 19 wherein said step of generating said expected signal includes generating said expected signal from a selectable signal for a specified region when camshaft position signal and said crankshaft position signal indicate that said engine is not synchronized.

24. The method of claim 23 wherein said step of comparing includes comparing an edge of said camshaft position signal to an edge of said expected signal when camshaft position signal and said crankshaft position signal indicate that said engine is not synchronized.

25. The method of claim 24 wherein said specified region is defined by a first crankshaft angle and a second crankshaft angle referenced relative to top dead center of a cylinder of said engine.

* * * * *